US006120618A

United States Patent [19]

Opalka

[11] Patent Number: 6,120,618

[45] Date of Patent: Sep. 19, 2000

[54] HYDROCARBON PHOSPHONIC ACID SURFACE TREATMENT THAT ELIMINATES HYDROGEN ABSORPTION AND ENHANCES HYDROGEN DEGASSING OF ALUMINUM AT ELEVATED TEMPERATURES

[75] Inventor: Susanne M. Opalka, Pittsburgh, Pa.

[73] Assignee: Alcoa Inc., Pittsburgh, Pa.

[21] Appl. No.: 09/349,665

[22] Filed: Jul. 8, 1999

Related U.S. Application Data

[63] Continuation-in-part of application No. 08/897,162, Jul. 18, 1997, abandoned.

[51] Int. Cl.[7] ..... C23C 22/00

[52] U.S. Cl. ..... 148/250; 148/259; 148/275; 148/703

[58] Field of Search ..... 148/250, 254, 148/259, 275, 703, 688; 106/14.12; 134/41

[56] References Cited

U.S. PATENT DOCUMENTS

| | | | |
|---|---|---|---|
| 2,885,313 | 5/1959 | Milliken | 148/6.27 |
| 2,885,315 | 5/1959 | Milliken | 148/13.1 |
| 2,885,316 | 5/1959 | Milliken | 148/13.1 |
| 2,995,479 | 8/1961 | Cochran et al. | 148/13.1 |
| 3,224,908 | 12/1965 | Duch et al. | 148/251 |
| 3,293,088 | 12/1966 | Herbst et al. | 148/6.15 |
| 4,391,655 | 7/1983 | Thurston et al. | 148/20.6 |
| 4,718,482 | 1/1988 | Iwana et al. | 165/133 |
| 5,052,421 | 10/1991 | McMillen | 134/2 |
| 5,277,788 | 1/1994 | Nitowski et al. | 205/175 |
| 5,409,156 | 4/1995 | Tsuji | 228/120 |
| 5,753,056 | 5/1998 | Opalka et al. | 148/703 |

FOREIGN PATENT DOCUMENTS

| | | |
|---|---|---|
| 0143715 | 5/1985 | European Pat. Off. . |
| 5422186 | 8/1977 | Japan . |
| 54-36908 | 11/1979 | Japan . |

*Primary Examiner*—John Sheehan
*Assistant Examiner*—Andrew L. Oltmans
*Attorney, Agent, or Firm*—Tracey D. Beiriger

[57] ABSTRACT

A method of controlling bulk absorption of atomic hydrogen and facilitating degassing of hydrogen from aluminum alloy workpieces during heat treatments in furnaces with ambient and/or moisture-laden atmospheres by exposing the surface of the workpieces to a low molecular weight solution or dispersion of an alkyl phosphonic acid, an olefinic phosphonic acid or an aryl phosphonic acid before subjecting the workpieces to heat treatments. The workpieces exposed to the phosphonic acid solution or dispersion are subjected to heat treatment in furnaces having ambient or moisture-laden atmospheres. The solution or dispersion involves chemical species that are deposited onto the aluminum surface from the phosphonic acid solution or dispersion which substantially decrease the amount of atomic hydrogen entering the bulk of the workpieces from their surfaces during heat treatment and, in addition, facilitate removal of atomic and molecular hydrogen from the bulk of the workpieces during heat treatment.

28 Claims, 1 Drawing Sheet

AVERAGE HYDROGEN LEVELS FOR VARIOUS SURFACE TREATMENTS

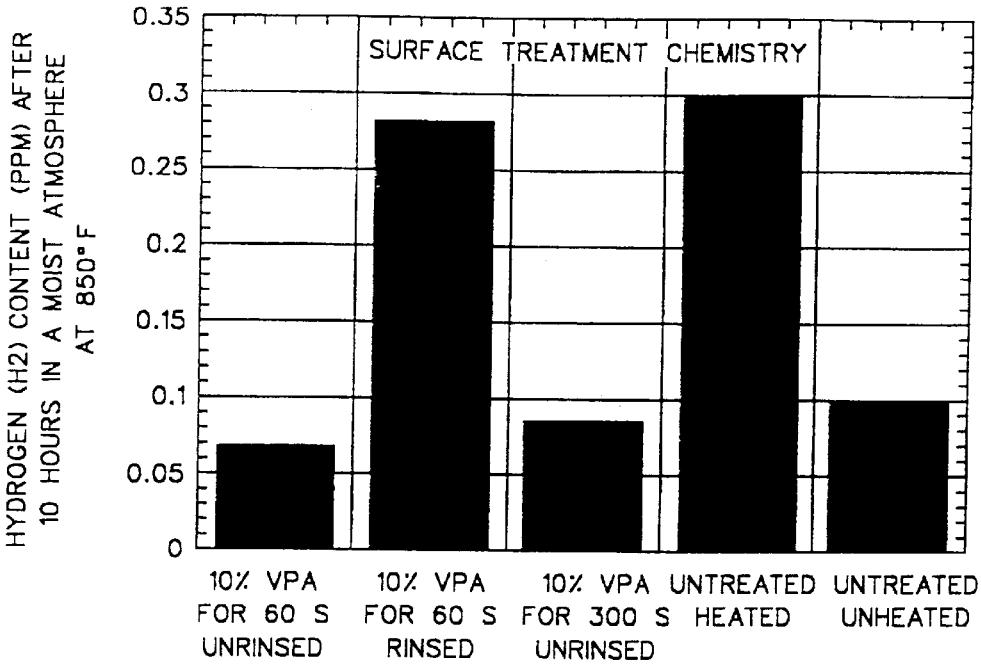
AVERAGE HYDROGEN LEVELS FOR VARIOUS SURFACE TREATMENTS

HYDROCARBON PHOSPHONIC ACID SURFACE TREATMENT THAT ELIMINATES HYDROGEN ABSORPTION AND ENHANCES HYDROGEN DEGASSING OF ALUMINUM AT ELEVATED TEMPERATURES

CROSS REFERENCE TO RELATED APPLICATIONS

This application is a continuation-in-part of application Ser. No. 08/897,162, filed on Jul. 18, 1997, now abandoned, the disclosure of which is fully incorporated by reference herein.

BACKGROUND OF THE INVENTION

The present invention relates generally to the problem of aluminum alloy workpieces absorbing hydrogen when undergoing heat treatment in furnaces containing ambient moisture-laden atmospheres, and particularly to a low molecular weight alkyl, alkylene or aryl phosphonic acid treatment that substantially reduces the absorption of hydrogen into aluminum alloy workpieces and, in addition, greatly enhances hydrogen degassing of such workpieces.

During the fabrication of aluminum alloy products, various types of heat treatments are used to: improve aluminum formability, improve compositional uniformity, relieve stresses and/or improve mechanical properties. The maximum aluminum alloy soak temperature varies with the alloy and type of heat treatment. These maximum metal soak temperatures typically fall within the range of about 454° C.–635° C. during preheats, within about 315° C.–471° C. during reheats, within about 315° C.–413° C. during anneals and within about 443° C.–552° C. during solution heat treatments. During these heat treatments, the protective oxide layer on the aluminum alloy workpieces is invariably disrupted to expose nascent aluminum. The exposed aluminum can undergo high temperature oxidation reactions with water producing oxidized aluminum phases and atomic hydrogen. Atomic hydrogen is the only gas that has appreciable solubility in solid aluminum and can readily diffuse into the aluminum object. Still, adsorbed atomic hydrogen has limited solubility and the propensity to precipitate as insoluble molecular hydrogen ($H_2$) at heterogeneities or defects, especially in the more highly deformed areas of an aluminum workpiece. As increasing molecular hydrogen is precipitated within the metal, additional atomic hydrogen can diffuse inward and be accommodated within the metal matrix. Precipitated molecular hydrogen forms secondary porosity, which may compromise the structural integrity and mechanical performance of the final aluminum part.

The movement of atomic hydrogen in aluminum alloy lattice with a given hydrogen concentration gradient is described quantitatively in terms of a diffusion coefficient. The hydrogen diffusion coefficient varies with the composition and history of the aluminum alloy workpiece, but always increases exponentially with increasing temperature. Thus, at room temperature, the diffusivity of atomic hydrogen in aluminum alloys is insignificant and the hydrogen contents of workpieces made therefrom will not change appreciably over time. At elevated heat treatment temperatures typically used of greater than 300° C., however, the diffusivity of hydrogen can play a dichotomous role in the control of hydrogen in aluminum alloy workpieces. If the atomic hydrogen concentration is greater at the surface of the aluminum workpiece than within the workpiece, hydrogen diffusion will progress inward and the bulk hydrogen content will increase. Thus, the increased diffusivity at elevated furnace temperatures above 300° C. can result in significant hydrogen accumulation in aluminum alloy workpieces during heat treatments, ultimately originating from water or water vapor in ambient furnace atmospheres. If, however, the atomic hydrogen concentration at the aluminum surface is less than within the bulk, hydrogen diffusion will progress outward and the bulk hydrogen content will decrease. Thus, the increased diffusivity at elevated furnace temperatures above 300° C. provides the opportunity to facilitate significant reduction of hydrogen already accumulated during casting and previous heat treatment processing.

For several decades, ammonium fluoborate ($NH_4BF_4$) protective atmospheres have been used in the industry to prevent substantial absorption of hydrogen by aluminum alloy workpieces during high temperature furnace treatments in the presence of moist air. Ammonium fluoborate decomposes at temperatures above 250° C. (during the initial heat ramp up to the maximum soak temperature) to form a blanket atmosphere that fills the entire internal volume of a furnace. Ammonium fluoborate also produces an array of compounds in the furnace which can eliminate high temperature oxidation reactions by either reacting with ambient water or by forming a protective fluorinated layer on the aluminum alloy workpiece.

There are drawbacks to the use of ammonium fluoborate atmospheres, however. Ammonium fluoborate species can stain and pit surfaces of some aluminum alloys. The ammonium fluoborate decomposition products contain toxic, corrosive and particulate species. The ammonium fluoborate emissions corrode furnace structures and baghouses for filtering particulate emissions. Disposal of the collected particulates is costly. Concerns relating to the emissions have prompted research to identify alternative chemistries that are more environmentally friendly and safer for in-plant use.

SUMMARY OF THE INVENTION

The present invention employs a solution or dispersion of a low molecular weight alkyl phosphonic acid, olefinic phosphonic acid or aryl phosphonic acid, for the treatment of aluminum alloy workpieces slated for heat treatments employing maximum metal soak temperatures ranging from about 300° C. to 635° C. This invention can also employ a solution or dispersion of low molecular weight hydrocarbon phosphonic acids containing other organic functional groups, such as amine phosphonic acids, alcohol phosphonic acids or carboxylic phosphonic acids. The deposition of low molecular weight hydrocarbon phosphonic acids on aluminum alloy workpieces has been shown to serve a dual role during subsequent heat treatments, both in facilitating the degassing of already absorbed hydrogen and in preventing the adsorption of additional hydrogen. The subject treatment can be applied to workpieces by dip spraying, roller coating or other known or subsequently developed techniques. It is applied by employing a minimum exposure time of about five seconds without subsequent rinsing prior to heat treatment. To minimize bulk hydrogen in aluminum alloy workpieces during subsequent heat treatments, the deposited chemistry must react with those sources of hydrogen present, including water vapor, to circumvent the formation of atomic hydrogen, and/or convert atomic hydrogen into chemical species that are insoluble in aluminum. To promote outward hydrogen diffusion, such a reaction pathway must minimize the hydrogen concentration at the surface by consuming any hydrogen generated by high temperature oxidation reactions at the surface or outgassed from the bulk of the workpiece.

The invention has been shown to be superior to ammonium fluoborate atmospheres in (i) promoting hydrogen degassing and (ii) preventing hydrogen adsorption during high temperature furnace heat treatments. In addition, this invention has the further advantage of substantially reducing particulate emissions as compared to fluoride and particulate emissions from furnace practices involving ammonium fluoborate atmospheres. The elimination of such particulates eliminates the need for and cost of baghouses and landfill sites for particulates. Further, the treatment application directly to the surfaces of aluminum components may dramatically reduce emissions as compared to the blanket protective atmosphere produced by bulk ammonium fluoborate decomposition.

In the compositions of the invention, the most effective low molecular weight hydrocarbon phosphonic acid compositions are of a concentration range sufficient to form an adsorbed layer of greater than a primary bonded monolayer on the aluminum workpiece surface. The effective concentration range has been found to be 0.05 to 2.00 molar low molecular weight hydrocarbon phosphonic acid. Polar organic solvents or water can be employed as the solvent carrier for the hydrocarbon phosphonic acid solutions or dispersions. In aqueous solutions containing less than 0.2 molar hydrocarbon phosphonic acids, the adsorption of phosphonic acids onto the aluminum surface is improved by acidifying the solution with a mineral acid, that does not contain phosphorus, to lower the pH to 2 or below.

The application of solutions containing at least 0.01 percent by weight of polymers or copolymers derived from vinyl phosphonic acid to metal surfaces was described in U.S. Pat. No. 3,293,088 ("Herbst"). Following application of these polymer solutions, the metal parts were dried at a temperature ranging from 80° C. to 200° C., depending on the solvent composition. That dried polymer layer served to minimize corrosion on the metal surfaces during subsequent storage and processing, and/or to improve adherence of subsequently applied organic coatings. Herbst thus taught that high molecular weight polymeric phosphonic acids yield superior corrosion and coating adhesion performance as compared to compositions containing only low molecular weight alkylene phosphonic acids. Note that polymers are generally macromolecules with extremely high molecular weight.

The present invention is not concerned with corrosion protection and/or adhesion promotion of coatings to metal surfaces as in Herbst. Rather, its focus is on using low molecular weight hydrocarbon phosphonic acids having molecular weights of less than 300 to reduce hydrogen content during aluminum heat treatment processing. The maximum soak temperatures employed for aluminum heat treatment processing encompass a much higher range of temperatures (300° C.–635° C.) than those used by Herbst for drying solvent from the applied polymeric phosphonic acid compositions. Under the Herbst temperature conditions, the diffusion coefficients for atomic hydrogen in aluminum alloys will be lower by several orders of magnitude or more. Thus, significant inward or outward diffusion can not occur in aluminum alloys stored at room temperature during extended periods of time, or during drying at temperatures up to 200° C. for up to 24 or 48 hours.

THE DRAWING

The objectives and advantages of the invention will be better understood from consideration of the following detailed description and the accompanying drawing, the sole figure of which is a bar plot showing average hydrogen levels in parts per million for various surface treatments including the treatment of the invention.

PREFERRED EMBODIMENT

It has been found that a low molecular weight phosphonic acid, specifically a 10 weight % (1.1 molar) vinyl phosphonic acid [VPA] aqueous solution or dispersion is particularly effective in preventing absorption of atomic hydrogen and in degassing hydrogen from the bulk of an aluminum alloy workpiece during furnace treatments in moist atmospheres, though a solution concentration range of a phosphonic acid of 0.05 to 2.00 molar, provides the benefits described herein. The pH of the solution can range between 0.5 and 2.0. For aqueous solutions with phosphonic acid concentrations below 0.25 molar, the solutions should be acidified with a mineral acid that does not contain phosphorus to a pH of 2.0 or below. Appropriate carriers, other than water, may be alcohols, glycols, glycol ether acetates or other polar organic liquids.

Similarly, a 0.25 to 1.0 molar vinyl phosphonic acid aqueous solution, with a range of pH from 0.7 to 2.0, respectively, is particularly effective in preventing absorption of atomic hydrogen and in degassing hydrogen from the bulk of an aluminum alloy workpiece during furnace treatments in moist atmospheres. Specific treatment conditions shown to be effective experimentally were a sixty second dip in a 10 weight % (1.1 molar) VPA aqueous solution with a pH of 1. Three samples treated in 10% VPA had an average hydrogen level of 0.07 ppm compared to nine untreated samples with an average of 0.30±0.03 ppm hydrogen level, following heating in a moist atmosphere. The former hydrogen level is distinguishable from a 0.10±0.02 average occurring from twelve unheated control samples.

Three samples rinsed for a period of sixty seconds in water following a sixty second dip in 10% VPA had an average 0.28 ppm hydrogen level. This level is not distinguishable from the above untreated, heated specimens, such that rinsing appears to displace a critical concentration of VPA from the aluminum surface that is necessary for minimizing bulk aluminum absorbed hydrogen during heat treatments. Rinsing in water could only remove VPA weakly absorbed onto the aluminum surface and not a primary monolayer of VPA species strongly bonded directly with the aluminum surface. Absorbed monolayers of phosphonic acids form hydrolytically stable linkages with the aluminum surface and take a significant period of time to reach an equilibrium configuration. This is discussed in U.S. Pat. No. 5,277,788, issued Jan. 11, 1994, to G. A. Nitowski, L. F. Wieserman and K. Wefers, and entitled Twice Anodized Aluminum Article Having an Organophosphorus Monolayer and Process for Making the Article. Secondary absorbed layers of VPA on aluminum surfaces form during treatment in solutions with concentrations of greater than 0.02 molar VPA. The equivalent effectiveness following a longer treatment time of five minutes in the 10% VPA composition, with an average 0.08 ppm hydrogen level, appears also to show that the formation of an equilibrium absorbed monolayer does not play a significant role in controlling bulk hydrogen. The hydrogen contents for all of these conditions are shown in the bar chart of the drawing.

Prior to heat treatment with the solution or dispersion of the invention, the aluminum workpiece can be subjected to a degreasing and/or cleaning with a solvent and/or alkaline etch followed by a deionized water rinse and/or an acidic desmutting step, followed by a deionized water rinse if the surface of the workpiece is particularly dirty.

In addition to the compositions of the above solutions or dispersions, certain additional agents can be incorporated in the compositions. There may be a need to use a solvent-based formulation to aid in drying or wetting of workpiece surfaces. The solvent of the solvent-based formulation can be selected from the group consisting essentially of alcohols, glycols, glycol ether acetates, or other polar organic liquids. There may be a need to use dispersants or surfactants to suspend insoluble hydrocarbon phosphonic acids in the solvent carrier. Surfactant species may also be incorporated to improve the formulation wetting on aluminum alloy workpiece surfaces and to ensure a more uniform surface reaction.

The above chemistry is effective in eliminating hydrogen absorption and enhancing hydrogen degassing. The application of such surface treatments directly to aluminum components dramatically reduces emissions, as compared to the blanket protective atmosphere produced by bulk ammonium fluoborate decomposition.

What is claimed is:

1. A method of controlling bulk absorption of atomic hydrogen and facilitating degassing of hydrogen from an aluminum alloy workpiece during heat treatment in furnaces with an ambient or moisture-laden atmosphere, the method comprising:

exposing the surface of an aluminum alloy workpiece to a solution of a low molecular weight hydrocarbon phosphonic acid selected from the group consisting of an alkyl phosphonic acid, an olefinic phosphonic acid, an aryl phosphonic acid, and combinations thereof, subjecting said workpiece exposed to the phosphonic acid solution to a heat treatment at temperatures greater than about 300° C., such that the deposited phosphonic acid substantially decreases the amount of atomic hydrogen entering the bulk of the workpiece during said heat treatment and facilitates removal of hydrogen from the bulk of the workpiece during said heat treatment.

2. The method of claim 1 wherein said workpiece is heat treated at temperatures in the range of about 315° C. to 635° C.

3. The method of claim 1 wherein said hydrocarbon phosphonic acid in solution is about 0.05 to 2.00 in molar concentration.

4. The method of claim 1 where said solution contains about 0.25 to 1.00 molarity olefinic phosphonic acid.

5. The method in claim 1 in which the solution has a solvent comprised predominantly of water.

6. The method in claim 1 wherein the solution has a pH ranging from about 0.5 to 2.0.

7. The method in claim 1 including acidifying the solution when phosphonic acid concentration is below 0.25 molarity with a mineral acid that does not contain phosphorus, to achieve a pH of 2.0 or below.

8. The method of claim 1 wherein the surface of the aluminum alloy workpiece is exposed to the phosphonic acid solution for a minimum exposure time of five seconds.

9. The method of claim 1 wherein the aluminum alloy workpiece exposed to the phosphonic acid solution is subjected to heat treatment without wiping or rinsing the workpiece surface prior to such heat treatment.

10. The method of claim 1 wherein prior to treatment with the hydrocarbon phosphonic acid solution the aluminum alloy workpiece is subjected to one or more of the following steps: degreasing, cleaning with a solvent, alkaline etching followed by a deionized water rinse, and an acidic desmutting step followed by a deionized water rinse.

11. The method of claim 1 wherein a solvent-based formulation is added to the alkyl, olefinic or aryl phosphonic acid solution to aid drying or wetting the aluminum alloy workpiece surface before the workpiece is subjected to heat treatment.

12. The method of claim 11 wherein the solvent of the added solvent-based formulation is selected from the group consisting of an alcohol, a glycol, a glycol ether acetate and combinations thereof.

13. The method of claim 1 wherein said hydrocarbon phosphonic acid has a molecular weight of less than 300.

14. A method of controlling bulk absorption of atomic hydrogen and facilitating degassing of hydrogen from an aluminum alloy workpiece during heat treatment in furnaces with an ambient or moisture-laden atmosphere, the method comprising:

exposing the surface of an aluminum alloy workpiece to a dispersion of a low molecular weight hydrocarbon phosphonic acid selected from the group consisting of an alkyl phosphonic acid, an olefinic phosphonic acid, an aryl phosphonic acid, and combinations thereof, before subjecting the workpiece to said heat treatment, subjecting said workpiece exposed to the phosphonic acid dispersion to a heat treatment at temperatures greater than about 300° C., such that the deposited phosphonic acid substantially decreases the amount of atomic hydrogen entering the bulk of the workpiece during said heat treatment and facilitates removal of hydrogen from the bulk of the workpiece during said heat treatment.

15. The method of claim 14 wherein said workpiece is heat treated at temperatures in the range of about 315° C. to 635° C.

16. The method of claim 14 wherein said hydrocarbon phosphonic acid in dispersion is about 0.05 to 2.00 in molar concentration.

17. The method of claim 14 where said dispersion contains about 0.25 to 1.00 molarity olefinic phosphonic acid.

18. The method in claim 14 which the dispersion has a solvent comprised predominantly of water.

19. The method in claim 14 wherein the dispersion has a pH ranging from about 0.5 to 2.0.

20. The method in claim 14 including acidifying the dispersion when phosphonic acid concentration is below 0.25 molarity with a mineral acid that does not contain phosphorus, to achieve a pH of 2.0 or below.

21. The method of claim 14 wherein the surface of the aluminum alloy workpiece is exposed to the phosphonic acid dispersion for a minimum exposure time of five seconds.

22. The method of claim 14 wherein the aluminum alloy workpiece exposed to the phosphonic acid dispersion is subjected to heat treatment without wiping or rinsing the workpiece surface prior to such heat treatment.

23. The method of claim 14 wherein prior to treatment with the hydrocarbon phosphonic acid dispersion the aluminum alloy workpiece is subjected to one or more of the following steps: degreasing, cleaning with a solvent, alkaline etching followed by a deionized water rinse, and an acidic desmutting step followed by a deionized water rinse.

24. The method of claim 14 wherein a solvent-based formulation is added to the alkyl, olefinic or aryl phosphonic acid dispersion to aid drying or wetting the aluminum alloy workpiece surface before the workpiece is subjected to heat treatment.

25. The method of claim 24 wherein the solvent of the added solvent-based formulation is selected from the group consisting of an alcohol, a glycol, a glycol ether acetate and combinations thereof.

26. The method of claim 14 wherein said hydrocarbon phosphonic acid has a molecular weight of less than 300.

27. A method of controlling bulk absorption of atomic hydrogen and facilitating degassing of hydrogen from an aluminum alloy workpiece during heat treatment in furnaces with an ambient or moisture-laden atmosphere, the method comprising:

exposing the surface of an aluminum alloy workpiece to a solution or dispersion of a low molecular weight hydrocarbon phosphonic acid selected from the group of an amine phosphonic acid, an alcohol phosphonic acid, an carboxylic phosphonic acid and combinations thereof, before subjecting the workpiece to said heat treatment, subjecting said workpiece exposed to the phosphonic acid solution or dispersion to a heat treatment at temperatures greater than about 300° C., such that the deposited phosphonic acid substantially decreases the amount of atomic hydrogen entering the bulk of the workpiece during said heat treatment and facilitates removal of atomic and molecular hydrogen from the bulk of the workpiece during said heat treatment.

28. The method of claim 27 wherein said workpiece is heat treated at temperatures in the range of about 315° C. to 635° C.

* * * * *